US006059699A

United States Patent [19]

Ramsey

[11] Patent Number: 6,059,699

[45] Date of Patent: May 9, 2000

[54] MEDICINE BALL TORSO RACK

[76] Inventor: Anthony Ramsey, 9443 Goddard, Overland Park, Kans. 66214

[21] Appl. No.: 09/076,501

[22] Filed: May 12, 1998

Related U.S. Application Data

[60] Provisional application No. 60/047,510, May 23, 1997.

[51] Int. Cl.[7] ..... A63B 23/02; A63B 47/00

[52] U.S. Cl. ..... 482/94; 482/92; 482/93; 482/148; 482/907; 446/168

[58] Field of Search ..... 482/92, 93, 140, 482/907, 148, 94; 446/168, 173, 172, 170; 473/109, 110, 111

[56] References Cited

U.S. PATENT DOCUMENTS

| | | | |
|---|---|---|---|
| D. 225,341 | 12/1972 | Schaefer . | |
| 1,835,857 | 3/1931 | Foehl . | |
| 2,936,176 | 5/1960 | Patterson . | |
| 3,879,039 | 4/1975 | Holden | 446/173 |
| 4,071,240 | 1/1978 | Camilleri . | |
| 4,790,529 | 12/1988 | Pelle | 446/168 X |
| 4,863,160 | 9/1989 | Pelle | 446/168 X |
| 5,624,322 | 4/1997 | Riley | 473/54 |
| 5,676,627 | 10/1997 | Howse | 482/97 |
| 5,728,031 | 3/1998 | Honeycutt | 482/83 |

*Primary Examiner*—Richard J. Apley
*Assistant Examiner*—Victor Hwang
*Attorney, Agent, or Firm*—Chase & Yakimo, L.C.

[57] ABSTRACT

An exercise device for use with a medicine ball utilizing a support frame with a seat thereon. A medicine ball track is mounted to the frame and is pivotal to a user selectable position of a plurality of positions at which one end of the track is higher than the opposed track end. A seated user facing away from the track initially places the medicine ball at the elevated track end upon torso rotation in one direction. The incline of the track causes a rolling movement of the ball to the lower track end for recovery by the user upon the user oppositely rotating the torso in order to reach the ball at the lower track end. Either end of the track may be elevated so as to provide a balanced exercise. The degree of elevation of the upper track end is adjustable which varies the speed of the ball rolling movement and thus the speed at which the user must rotate between the ball placement and recovery positions. A selector plate positions and maintains the track at a desired inclination.

24 Claims, 8 Drawing Sheets

MEDICINE BALL TORSO RACK

CROSS-REFERENCE TO RELATED APPLICATION

This application claims the benefit of the prior filed, co-pending provisional application, Ser. No. 60/047,510, filed on May 23, 1997.

BACKGROUND OF THE INVENTION

This invention relates to an exercise machine and, more particularly, to a machine which is designed to be best used with a medicine ball.

Heretofore, one effective exercise for use with a medicine ball was for two users to stand or sit back-to-back. Upon a first user grasping the medicine ball the first user would rotate the torso in a clockwise or counterclockwise direction and hand it to the second user. Once received the second user would then rotate the torso so as to return the medicine ball to the opposite side of the first user. This exchange of the medicine ball would continue between the users in either clockwise or counterclockwise direction so as to exercise the muscles of the users' torsos. Although this exercise is effective in operation, the absence of a workout partner precludes one from effectively performing this exercise.

In response thereto I have designed a device which enables one to perform a similar exercise with a medicine ball but without a workout partner. Generally my now preferred device comprises a frame with a ball track attached thereto, the track presenting a course for rolling movement of a medicine ball between opposed ends of the track. The track is pivotally mounted to the frame so that the opposed ends of the track can be pivoted to various relative positions at which one end of the track is elevated relative to the lower opposed end of the track. A seat on the frame allows the user to sit with the user's back to the track. Upon rotation of the torso the medicine ball is initially positioned by the user at the elevated end of the track. The medicine ball then rolls to the opposite lower end of the inclined track. The user rotates the torso in an opposed direction toward the lower end of the track to recover the medicine ball. This torso motion between the initial ball placement and ball recovery positions exercises the torso muscles of the user. After a desired number of repetitions the track can then be pivoted so that the lower end becomes the elevated end. The user then performs the initial positioning and ball recovery movements in opposed directions thus exercising the opposed muscles of the torso. The elevation of one end of the track above the horizontal can be adjusted so as to vary the ball's rolling speed and thus the degree of exertion needed by the user to move between the ball placement and recovery positions. Foot holds on the frame allow the user upon facing the track to do sit ups. Various types of exercises can be utilized in connection with my device.

Accordingly, it is a general object of this invention to provide an exercise device for exercising the torso muscles.

Another object of this invention is to provide a device, as aforesaid, which enables one person to perform torso exercises with a medicine ball.

A further object of this invention is to provide a device, as aforesaid, which eliminates the need to have a workout partner when performing exercises with a medicine ball.

Still a further object of this invention is to provide a device, as aforesaid, which adjusts the degree of exertion needed to be utilized by the user.

A further object of this invention is to provide a device, as aforesaid, having a track for the medicine ball, the track being adjustable in slope to vary the speed and direction of the medicine ball along the track.

Another object of this invention is to provide a device, as aforesaid, which enables one to perform various medicine ball exercises with ease, effective and convenience.

Another particular object of this invention is to provide a device, as aforesaid, which assists the user in the development of speed, flexibility and coordination.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
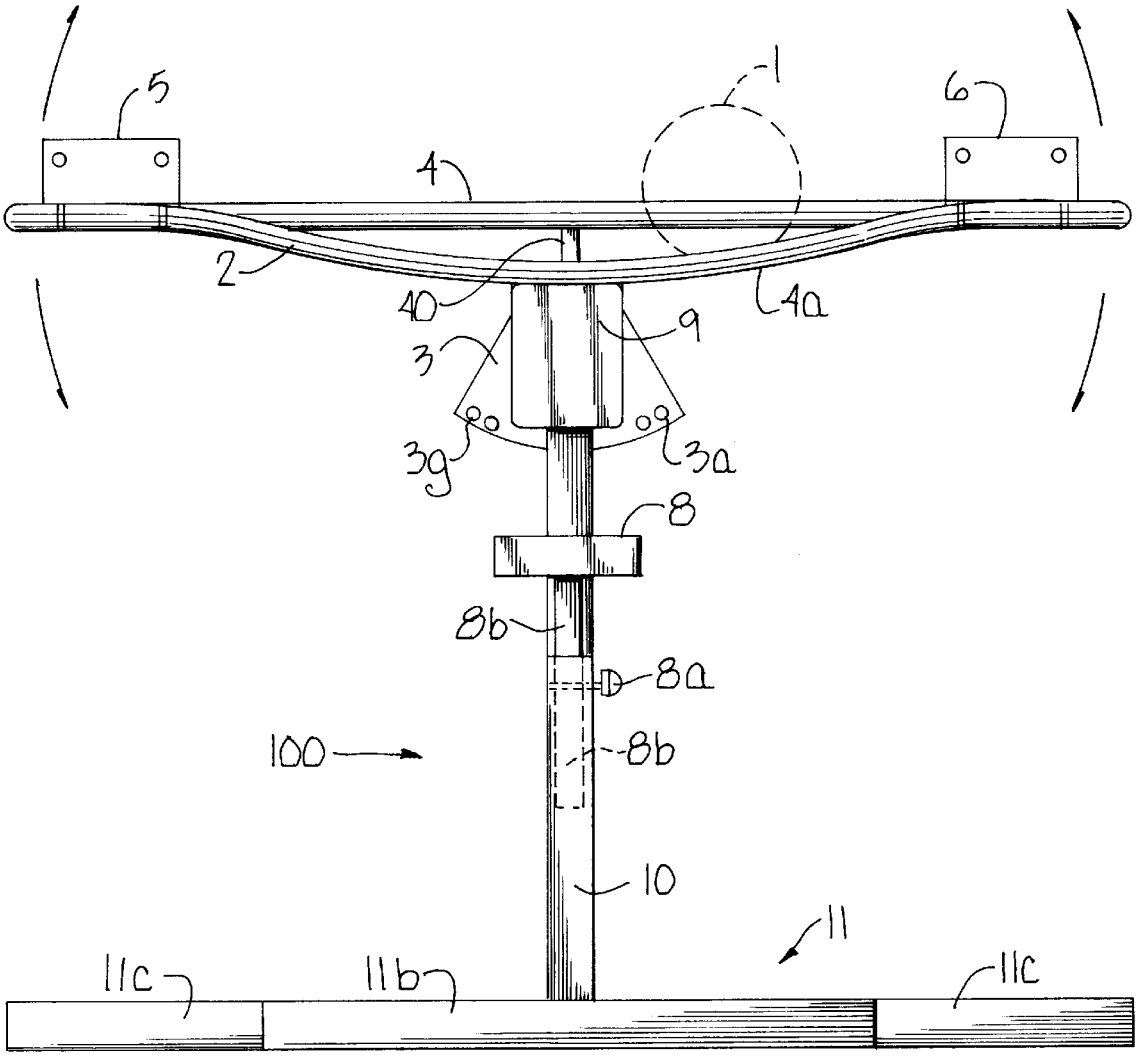
FIG. 1 is a front elevation view of the medicine ball rack with the ball track in a horizontal position.
Figure 2:
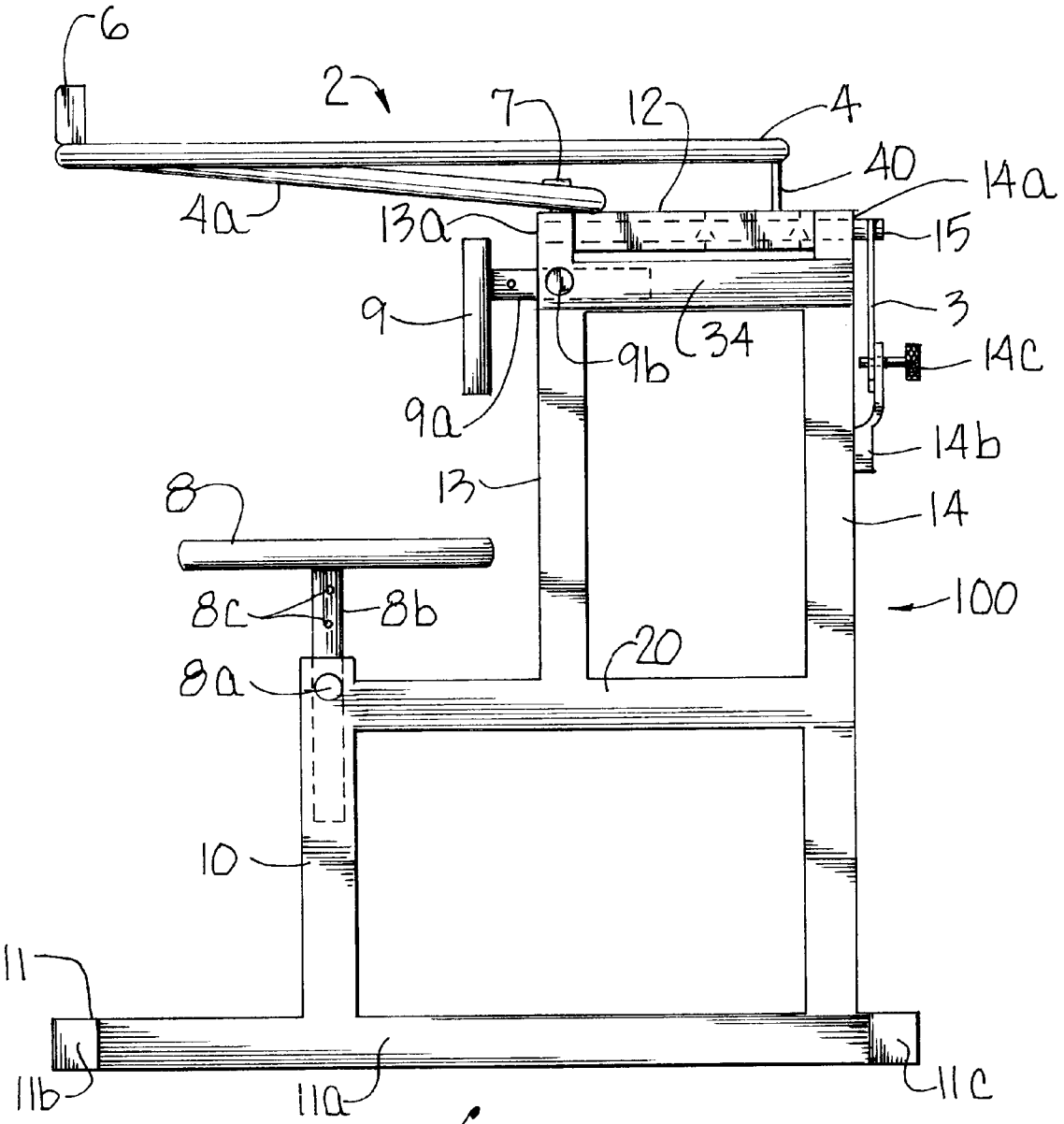
FIG. 2 is a side elevation of the medicine ball rack, the opposed side being a mirror image thereof.
Figure 3:
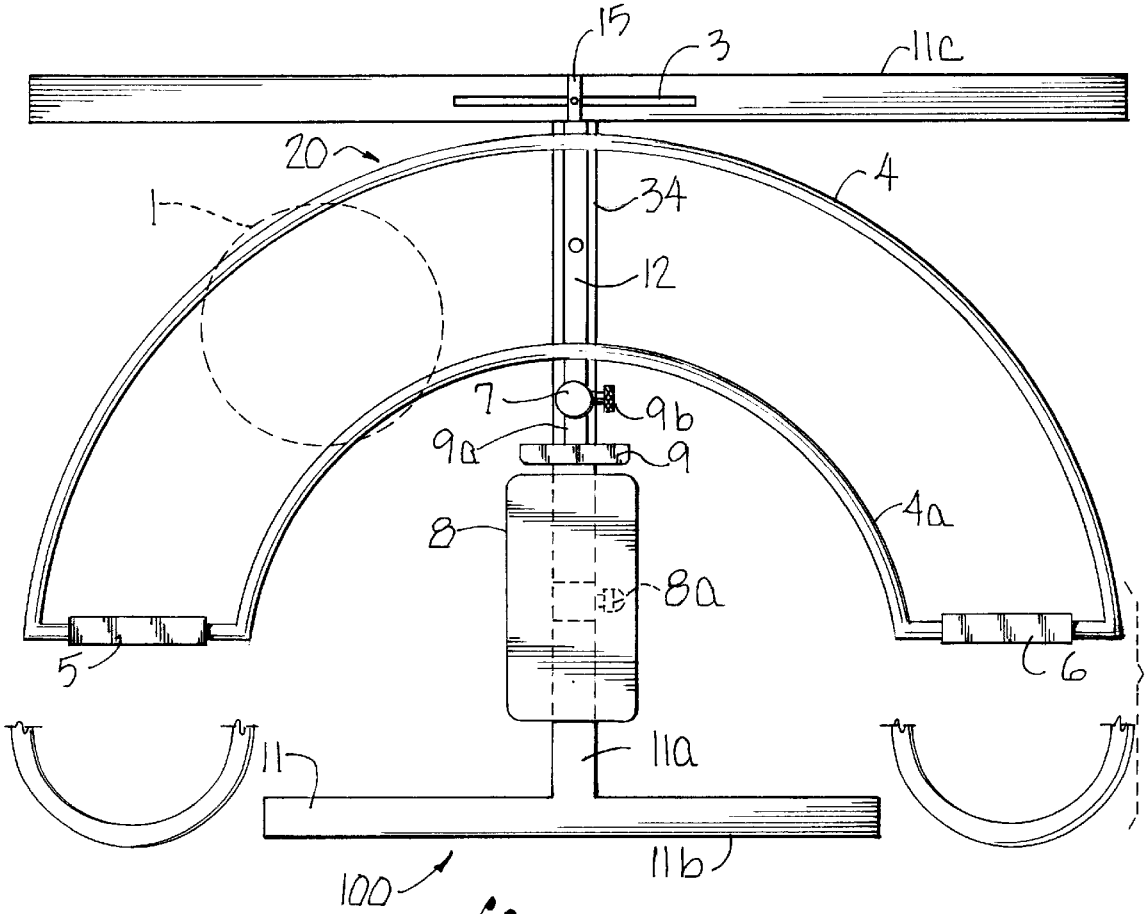
FIG. 3 is a top view of the medicine ball rack showing alternative track ends.

Turning more particularly to the drawings, FIG. 1 shows the torso rack as comprising a support frame 100. The frame 100 includes a horizontal base frame 11 which comprises a first ground adjacent base strut 11*a* with normal ground-adjacent front 11*b* and rear 11*c* struts at opposed ends of strut 11*a*. A vertical frame extends from the strut 11*a* and comprises a front post/column 10 having a seat 8 thereon. Seat 8 is attached to a depending post 8*b* which nests in the vertical column 10. Up and down movement of post 8*b* within column 10 adjusts the seat 8 height. Seat 8 is held at a selected height by a pin 8*a* extending through an aperture in the column 10 and a selected aperture 8*c* of a plurality of apertures in the seat post 8*b*.

Vertically extending from the rear of the base frame strut 11*a* is a rear strut 14. A vertical strut 13 extends from a cross brace 20 extending between front post 10 and rear strut 14. Struts 13, 14 present upper ends 13*a*, 14*a*. A shaft 12 rotatably extends between the upper ends 13*a*, 14*a* of struts 13, 14. An inner solid shaft 15 extends through the free ends 13*a*, 14*a* of struts 13 and 14 and through shaft 12 and presents an end beyond strut 14. A rotation of inner shaft 15 will likewise rotate the surrounding cylindrical shaft 12.

Attached to this shaft 12 is a track 2 for the medicine ball 1. The track is presented by a frame presenting a rear rail 4 and front rail 4*a* having stop pads 5, 6 at the first and second opposed track ends. The rails 4, 4*a* are spaced apart to allow a medicine ball 1 to seat therebetween. The rear rail 4 is slightly higher than the front rail 4*a* to preclude the medicine ball 1 from unseating during medicine ball rolling movement.

Extending from the rear rail 4 at the midpoint is thereof is a depending flange member 40 which is connected to the outside shaft 12. The midpoint of front rail 4*a* itself is also connected to shaft 12. Thus, rotation of shaft 15 will rotate shaft 12 and pivot the track 2 connected to shaft 12.

Figure 4:
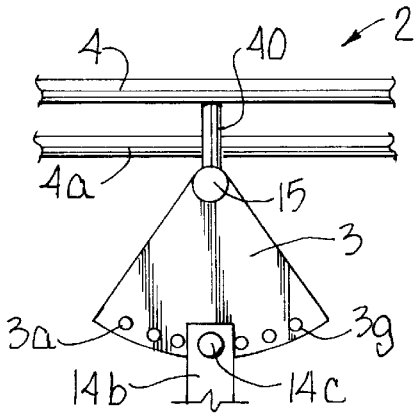
FIG. 4 is a fragmentary rear view of the plate and bracket forming the slope selector for the track of the medicine ball rack.
Figure 5:
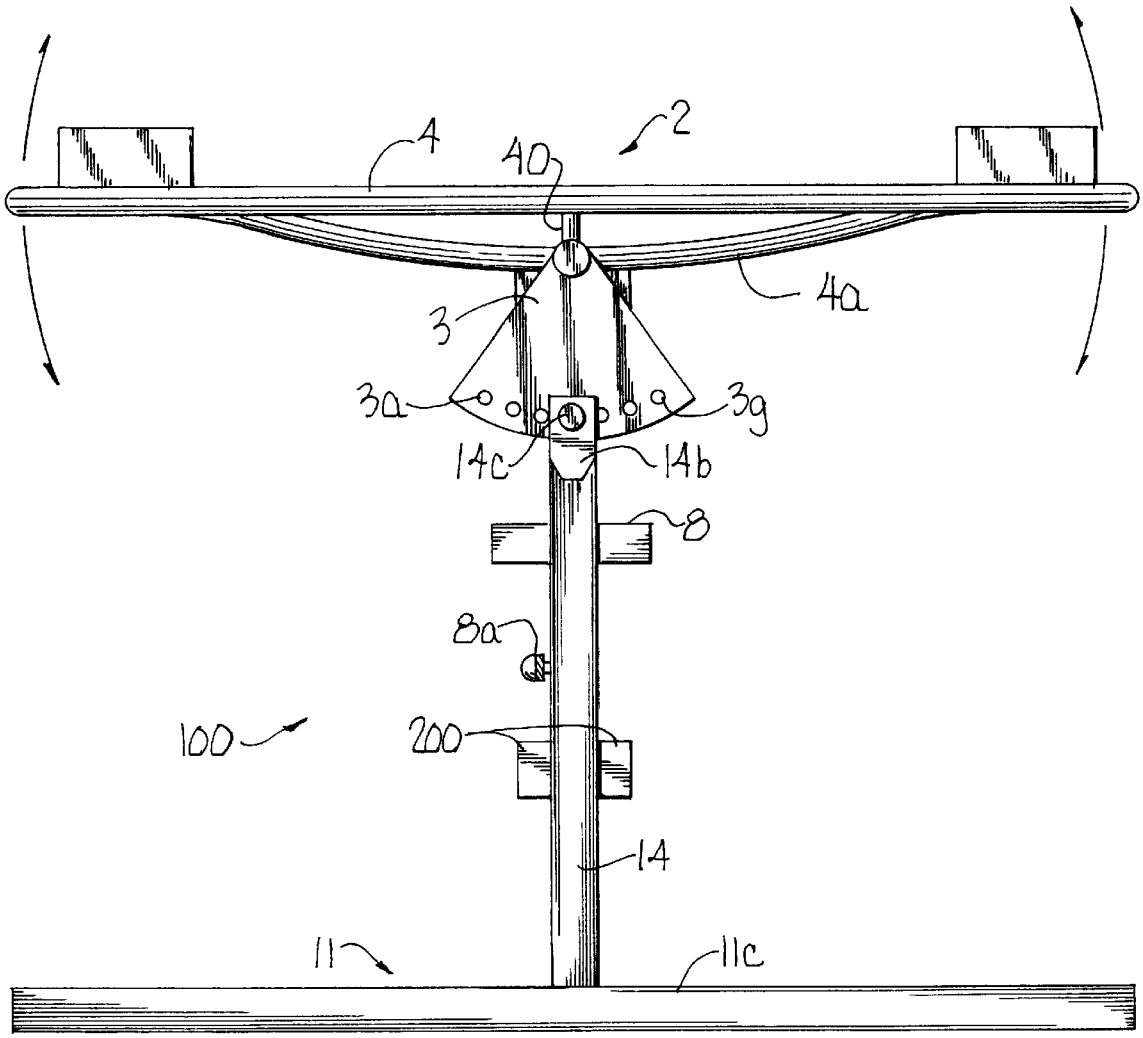
FIG. 5 is a rear view of the medicine ball rack of FIG. 1.
Figure 6:
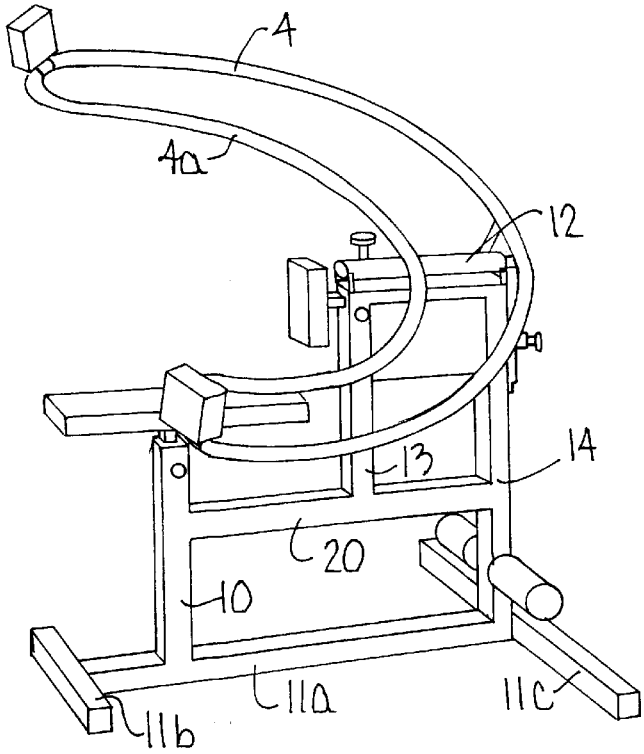
FIG. 6 is a perspective view of the medicine ball rack from one side thereof showing one end of the medicine ball track in an elevated position.
Figure 7:
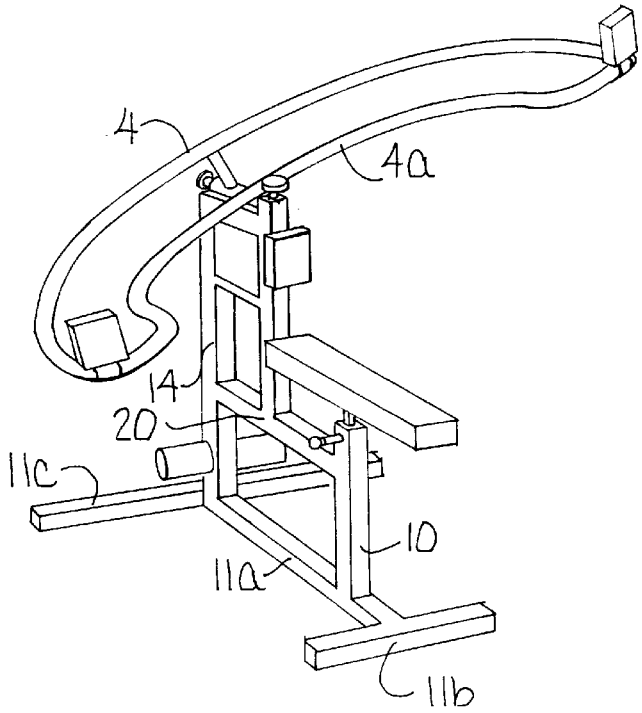
FIG. 7 is a perspective view of the medicine ball rack showing the opposed end of the rack of FIG. 6 in an elevated position.
Figure 6A:
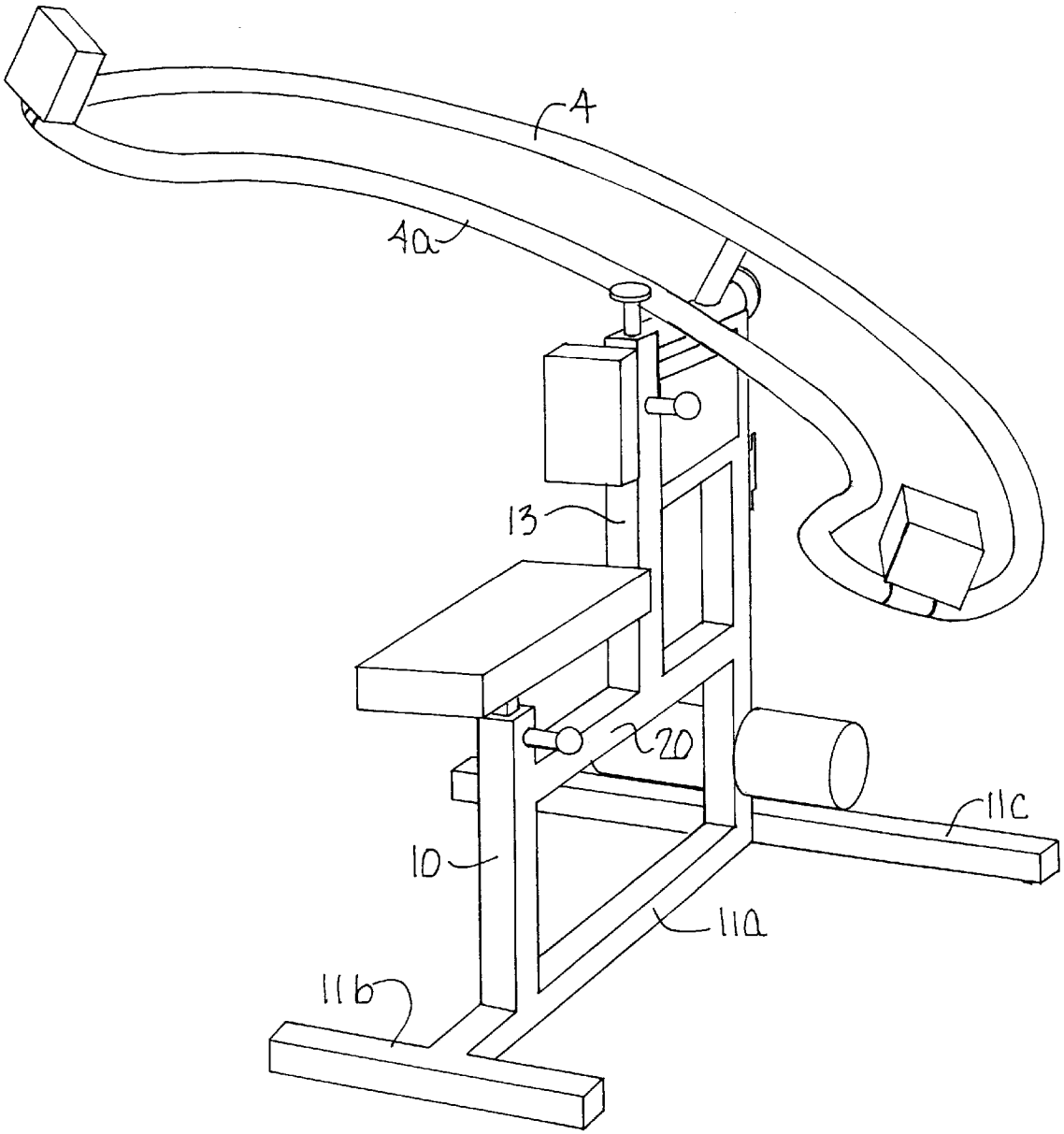
FIG. 6A is a perspective view of the rack of FIG. 6 from another side thereof.

Attached to the opposed extending end of shaft 15 is a triangular-shaped plate 3. The plate 3 has a plurality of apertures 3*a*–3*g* therein (FIGS. 4, 5). Further extending from the frame strut 14 is a bracket 14*b* presenting an arm with an aperture therein for extension of a pin 14*c* therethrough. Upon alignment of the aperture in bracket 14*b* with a selected plate 3 aperture of a plurality of apertures 3*a*–3*g*, the shaft 15 rotates which concurrently rotates outer shaft 12. Thus, track 2 will be concurrently inclined at a selected angle relative to the horizontal. An anchor screw 7 extends through the top of strut 13 and is user threadable to bear against an end of shaft 15 to preclude shaft 15 rotation. Thus, screw 7 further maintains the track 2 at a selected angle. The alignment of the left most aperture 3*a*, as viewed in FIG. 5, in plate 3 with the bracket 14*b* aperture provides the highest degree of elevation of the right track end (as viewed) as the counterclockwise movement of the slope selector 3 will likewise rotate the shaft 15 in a counterclockwise direction and thus elevate the right end of the track. Likewise, in rotating the plate 3 in a clockwise direction such that the opposed right most aperture 3*g* is in alignment with the bracket 14*b* aperture, the shaft 15 rotates in a clockwise direction and thus positions the opposed left end of the track at the highest elevated position. As above explained insertion of the pin 14*c* through the aligned plate aperture and bracket aperture maintains the slope of the track at the selected position. Accordingly, it can be seen that the slope selector plate 3 allows the opposed ends of the track to be positioned between their most elevated positions as well as positions therebetween as provided by the intermediate apertures found on the slope selector plate 3. As shown in the FIG. 5 the middle aperture of the plurality of apertures is in alignment with the bracket 14*b* apertures which places the track 2 at a relatively horizontal position.

Foot rests extend from the rear vertical strut 14. Upon the feet of the user being placed underneath these rests the user can do sit ups, if so desired.

A back pad 9 attached to post 9*a* is slidable within the upper cross brace 34 which joins struts 13, 14. A pin 9*b* extends through apertures in post 9*a* and strut 34 so as to maintain the desired displacement of back pad 9 from strut 13. Thus, as both the back pad 9 and seat 8 are adjustable, variously sized users can utilize the device in a seated position.

Figure 8:
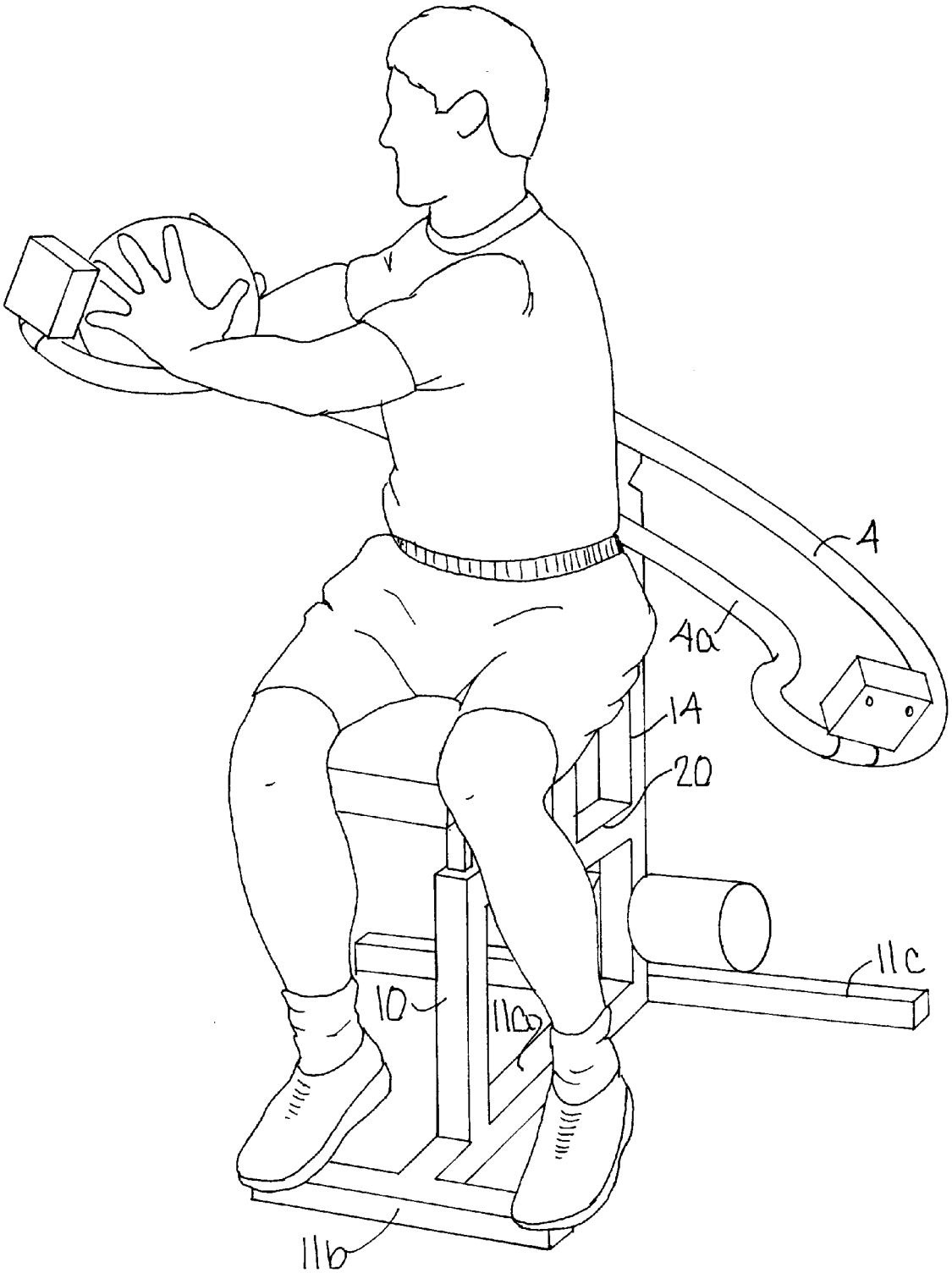
FIG. 8 is a perspective view showing a user thereon at an initial ball placement position facing the elevated end of the track.
Figure 9:
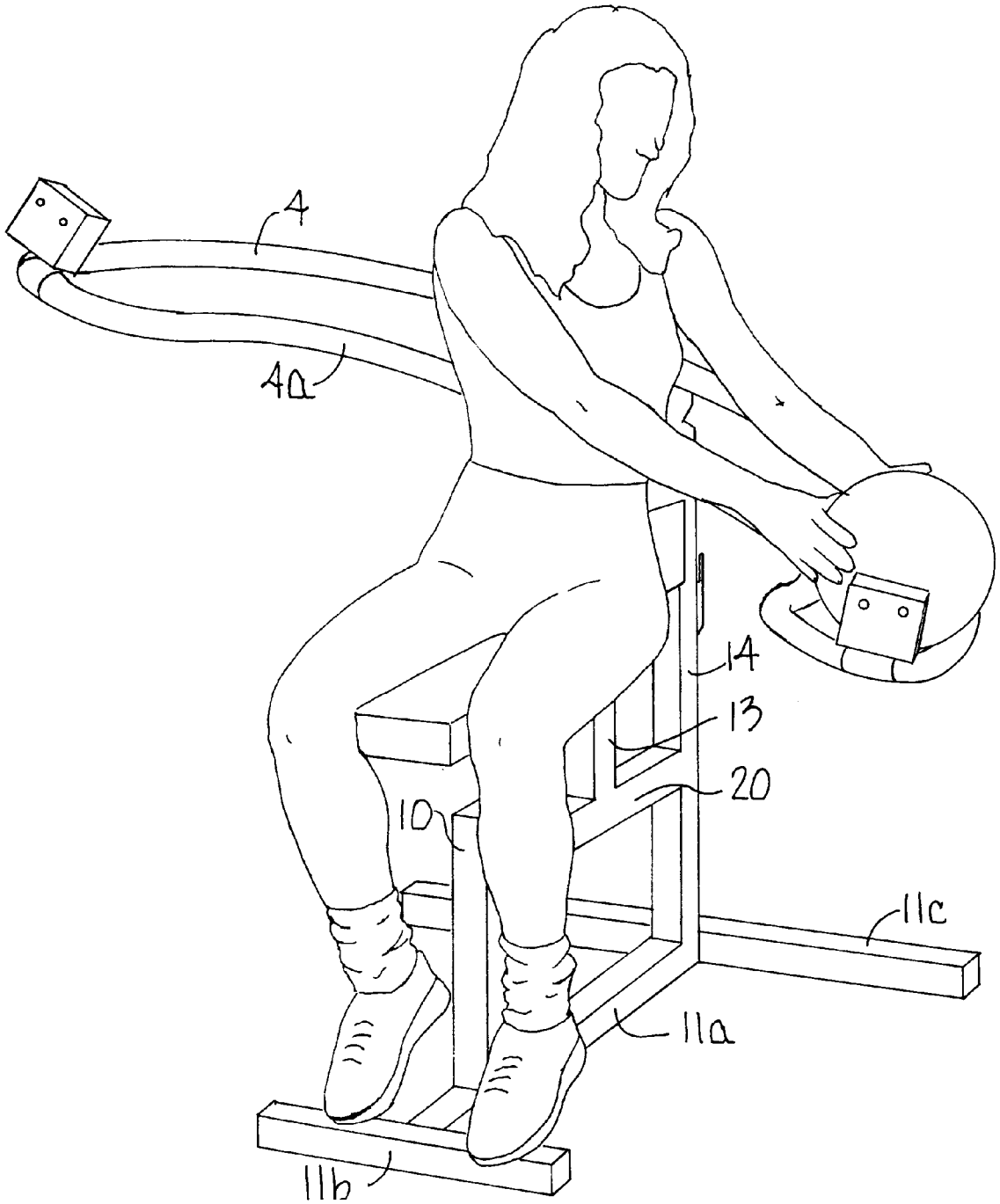
FIG. 9 is a perspective view showing a user thereon at a ball recovery position facing the lower end of the medicine ball track.

FIGS. 8 and 9 show the device in use. In FIG. 8 the seated user has his back to the track 2 and has first rotated his torso in a clockwise direction and placed the medicine ball at an initial position on the elevated end of the track 2. Upon release the medicine ball 1 will roll to the opposed lower track end. During this movement the user rotates his torso in an opposed counterclockwise direction so as to position the torso for recovering the medicine ball at the opposed end of the track. FIG. 9 shows a user at the recovery position for the medicine ball at the non-elevated end of the track. The back and forth movement of the user between the initial ball placement and ball recovery positions along with the weighted medicine ball exercises the muscles of the user. By use of the slope selector 3 as above described the angle of inclination the track 2 can be adjusted which will vary the speed of rolling movement of the medicine ball between the upper and lower ends of the track 2. Concurrently, the speed of user movement between the initial ball placement and recovery positions will also have to be adjusted according to the track 2 slope and the increase or decrease in ball speed. Also, the selector 3 can elevate either end of the track for initial ball placement. Thus the user's torso may rotate in an opposed direction between the initial and recovery positions so as to achieve an exercise balance.

Accordingly, it can be seen that the above combination of elements allows a user to perform various exercises in connection with the device 100, the type of exercises not being limited to that as above described. Moreover, the user need not be seated during performance of such exercises.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. An exercise device for use with a ball manipulated by a user comprising:

a support frame;

a track having first and second ends adapted to present a course for a rolling movement of a ball;

a rotatable shaft mounted to said frame with said track mounted thereto, said shaft rotatable about an imaginary shaft axis longitudinally extending through said shaft, said track pivotal between one position wherein said first end of said track is elevated relative to said second track end upon rotatable movement of said shaft about said imaginary shaft axis in a first clockwise direction and an opposed position wherein said second track end is elevated relative to said first track end upon rotatable movement of said shaft about said imaginary shaft axis in a second opposed counterclockwise direction, whereupon a user at a first body position places the ball at said elevated track end and at a second body position recovers the ball at said lower track end upon the ball rolling thereto along said track, a movement of the user between the first ball placement and second recovery positions exercising the user.

2. The device as claimed in claim 1 further comprising means on said frame for maintaining said first track end at a position relative to said second track end.

3. The device as claimed in claim 2 wherein said maintaining means comprises:

a plate at one end of said shaft;

a plurality of apertures in said plate;

a bracket on said frame adjacent said plate;

an aperture in said bracket, an alignment of one of said plate apertures with said bracket aperture providing said movement of said shaft and said track attached thereto;

a pin extending through said aligned plate and bracket apertures to preclude movement of said plate and said shaft attached thereto.

4. The device as claimed in claim 2 wherein said maintaining means comprises:

means on one end of said shaft for associating a plurality of apertures with said shaft;

means on said frame for presenting an aperture associated with said frame for alignment with one of said plurality of associated shaft apertures;

means for holding said shaft and frame apertures in said alignment to preclude movement of said shaft and said associated track.

5. The device as claimed in claim 1 further comprising a seat on said frame adapted for supporting the user thereon during user movement between the first ball placement and second recovery positions.

6. The device as claimed in claim 5 wherein the user on said seat faces away from said track.

7. The device as claimed in claim 5 further comprising a back pad attached to said frame, said back pad adapted to support a back of a user on said seat.

8. An exercise device adapted for use with a ball manipulated by a user comprising:

a support frame;

a track having first and second ends adapted to present a course for a rolling movement of a ball;

means for mounting said track to said frame at a user-selectable inclined positions relative to said frame, said mounting means including a shaft rotatably mounted to said frame about a longitudinal axis passing through said shaft with said track mounted to said shaft, a rotation of said shaft in first or second opposed directions about said longitudinal axis relatively elevating one end of said track higher than an opposed lower track end to selectively incline said track, said inclined track adapted to present a course for rolling movement of a ball therealong between said higher and lower track ends, a movement of a user between a first position placing a ball at said higher end and a second position recovering the ball at said lower end providing for a user exercise.

9. The device as claimed in claim 8 further comprising means on said frame for maintaining said one track end at a user selectable position relative to said second track end.

10. The device as claimed in claim 9 wherein said maintaining means comprises:

a flange at one end of said shaft;

a plurality of apertures in said flange;

a bracket on said frame adjacent said flange;

an aperture in said bracket, an alignment of one of said flange apertures with said bracket aperture providing said rotation of said shaft and movement of said track attached thereto;

a pin extending through said aligned flange and bracket apertures to preclude movement of said flange and said shaft attached thereto.

11. The device as claimed in claim 9 wherein said maintaining means comprises:

means on one end of said shaft for associating a plurality of apertures with said shaft;

means on said frame for presenting an aperture associated with said frame for alignment with one of said plurality of associated shaft apertures;

means for holding said shaft and frame apertures in said alignment to preclude movement of said shaft and said associated track.

12. The device as claimed in claim 8 further comprising a seat on said frame for user support thereon.

13. An exercise device adapted for use with a ball manipulated by a user comprising:

a support frame;

a track having first and second ends adapted to present a course for a ball;

a shaft rotatably mounted to said frame;

means for mounting said track with said shaft whereupon a user selectable rotation of said shaft in opposed directions selectably elevates one of said track ends relative to the other of said track ends to provide a selectably inclined track having selectable speeds of ball movement between said track ends corresponding to a degree of elevation of one track end above the other track end, whereupon a user at a first body position relative to said track places the ball on one of said track ends and at a second body position relative to said track recovers the ball at said other of said track end upon the ball rolling between said track between said ends, a speed of movement of the user between the ball placement and a successful recovery position corresponding to a speed of the ball along said track.

14. The device as claimed in claim 13 further comprising means for maintaining said track ends at said elevated and lowered positions.

15. The device as claimed in claim 14 wherein said maintaining means comprises a plate at one end of said shaft;

a plurality of apertures in said plate;

a bracket on said frame adjacent said plate;

an aperture in said bracket, an alignment of one of said plate apertures with said bracket aperture rotating said shaft and said track mounted thereto;

a pin extending through said aligned plate and bracket apertures to preclude movement of said plate and said shaft attached thereto.

16. The device as claimed in claim 14 wherein said maintaining means comprises:

means on one end of said shaft for associating a plurality of apertures with said shaft;

means on said frame for presenting an aperture associated with said frame for alignment with one of said plurality of associated shaft apertures;

means for holding said shaft and frame apertures in said alignment to preclude movement of said shaft and said associated track.

17. The device as claimed in claim 13 wherein said track comprises first and second spaced apart rails for seating the ball therebetween.

18. The device as claimed in claim 13 further comprising a seat associated with said frame for user support thereon.

19. An exercise device adapted for use with a ball manipulated by a user comprising:

a support frame;

a track having first and second ends adapted to present a course for a rolling movement of a ball;

means for mounting said track to said frame at an inclined position relative to said frame wherein said first end of said track is higher than a second lower track end, said inclined track adapted to present a course for rolling movement of a ball therealong between said higher and lower ends, a movement of a user between a first position placing a ball at said higher end and a second position recovering the ball at said lower end providing for a user exercise;

a flange on said mounting means;

a plurality of apertures in said flange;

an aperture on said frame adjacent said flange, an alignment of one of said flange apertures with said frame aperture providing said inclined position of said track relative to said frame;

means for maintaining said aligned flange and frame apertures in said alignment to preclude movement of said track from said inclined position.

20. The device as claimed in claim 19 wherein said mounting means comprises a shaft mounted to said frame with said track mounted to said shaft, a rotation of said shaft about an axis passing through said shaft in one direction elevating said first track end and lowering said second track end, a rotation of said shaft in a second direction about said axis lowering said first track end and elevating said second track end.

21. The device as claimed in claim 20 wherein said flange is attached to said shaft.

22. The device as claimed in claim 19 further comprising a seat associated with said frame for user support thereon.

23. An exercise device for use with a ball manipulated by a user comprising:

a stationary support frame;

a track having first and second ends adapted to present a course for a rolling movement of a ball between said first and second ends;

means for mounting at least said first track end in rotatable movement about a fixed, imaginary longitudinal axis extending through said frame, a user exertion on said track rotating said first track end about said imaginary longitudinal axis in a manner to selectably position said first track end at a selectable higher or lower position relative to said second track end;

means for maintaining said first track end at said selectable position relative to said second track end, whereupon a user at a first body position places the ball at a higher of said track ends and recovers the ball at a lower of said track ends upon the ball rolling thereto along said track, a movement of the user between the first and second body positions exercising the user.

24. The device as claimed in claim 23 further comprising a seat associated with said support frame for user support thereon.

* * * * *